US008485642B2

(12) United States Patent
Hayashi et al.

(10) Patent No.: US 8,485,642 B2
(45) Date of Patent: Jul. 16, 2013

(54) INK TANK AND INK SUPPLY SYSTEM

(75) Inventors: Hiroki Hayashi, Yokohama (JP); Wataru Takahashi, Kawasaki (JP); Masashi Ogawa, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 800 days.

(21) Appl. No.: 11/840,757

(22) Filed: Aug. 17, 2007

(65) Prior Publication Data

US 2008/0049080 A1 Feb. 28, 2008

(30) Foreign Application Priority Data

Aug. 23, 2006 (JP) ..... 2006-227175
Aug. 8, 2007 (JP) ..... 2007-207156

(51) Int. Cl.
*B41J 2/14* (2006.01)
*B41J 2/175* (2006.01)

(52) U.S. Cl.
USPC ..... 347/49; 347/86

(58) Field of Classification Search
USPC ..... 347/19, 49, 85, 86
See application file for complete search history.

(56) References Cited

U.S. PATENT DOCUMENTS

| | | | | |
|---|---|---|---|---|
| 5,619,237 | A | 4/1997 | Inoue et al. | 347/86 |
| 6,102,533 | A | 8/2000 | Nozawa et al. | 347/86 |
| 6,302,530 | B1 | 10/2001 | Shimada et al. | 347/86 |
| 6,375,315 | B1 * | 4/2002 | Steinmetz et al. | 347/86 |
| 6,746,110 | B2 | 6/2004 | Hayashi | 347/86 |
| 6,955,422 | B2 * | 10/2005 | Miyazawa et al. | 347/86 |
| 6,966,631 | B2 | 11/2005 | Matsuo et al. | 347/49 |
| 7,118,194 | B2 | 10/2006 | Matsuo et al. | 347/49 |
| 7,125,109 | B2 | 10/2006 | Watanabe et al. | 347/86 |
| 7,165,829 | B2 | 1/2007 | Hayashi et al. | 347/49 |
| 2004/0061751 | A1 | 4/2004 | Hayashi et al. | 347/86 |
| 2004/0246304 | A1 | 12/2004 | Takahashi et al. | 347/49 |
| 2006/0082625 | A1 | 4/2006 | Kotaki et al. | 347/86 |
| 2006/0087538 | A1 | 4/2006 | Amma et al. | 347/86 |
| 2008/0001985 | A1 | 1/2008 | Hatasa et al. | 347/19 |
| 2008/0049081 | A1 | 2/2008 | Hayashi et al. | 347/86 |

FOREIGN PATENT DOCUMENTS

| | | |
|---|---|---|
| CN | 1385307 | 12/2002 |
| EP | 655336 | 5/1995 |
| EP | 698497 | 2/1996 |

(Continued)

OTHER PUBLICATIONS

Extended European Search Report dated Nov. 28, 2007 from corresponding European Application No. 07114769.8.

*Primary Examiner* — Anh T. N. Vo
(74) *Attorney, Agent, or Firm* — Fitzpatrick, Cella, Harper & Scinto

(57) ABSTRACT

An ink tank is attachable to the attachment section by positioning first engagement sections at first fitting sections on the attachment section and then locking a second engagement section to a second fitting section of the attachment section by rotating the tank. The multiple supply ports are arranged on a bottom face of the tank such that the supply ports are on both sides of a center line in a width direction of the tank, and that distances between each of abutting centers configured to abut ink receiving parts of the attachment section, and the first engagement section side in a direction along a center line are mutually different. It is possible to avoid reception of a reactive force to the ink receiving parts at one time when rotating and attaching the tank, and to achieve stable attachment while suppressing excessive inclination of the tank at the time of attachment.

22 Claims, 13 Drawing Sheets

FOREIGN PATENT DOCUMENTS

| | | |
|---|---|---|
| EP | 829363 | 3/1998 |
| EP | 1484181 | 12/2004 |
| JP | 08-058107 | 3/1996 |
| JP | 08-224883 | 9/1996 |
| JP | 10-286972 | 10/1998 |
| JP | 2002-036584 | 2/2002 |
| JP | 2002-052733 | 2/2002 |
| JP | 2004-122460 | 4/2004 |
| JP | 2004-249710 | 9/2004 |
| JP | 2004-358914 | 12/2004 |

* cited by examiner

INK TANK AND INK SUPPLY SYSTEM

BACKGROUND OF THE INVENTION

1. Field of the Invention

The present invention relates to an ink tank and an ink supply system, and, more specifically, to an ink tank and an ink supply system to be applied to an inkjet printing apparatus.

2. Description of the Related Art

Along the advance of image quality of printing in recent years, commonly employed in inkjet printing apparatuses is a method of increasing the number of ink colors used for printing in order to improve the image quality targeting for photographic image quality. A method of providing multiple tanks is widely used in a desktop printing apparatus, the tanks prepared respectively for different colors and being independently detachable. Such a configuration, however, causes an increase in the number of ink tanks, whereby the frequency of tank replacing operations by a user is increased. Moreover, as the ink tanks are provided independently, the wall thickness of each of the ink tanks has a great influence on the size of the printing apparatus.

Accordingly, from the viewpoint of user friendliness and of downsizing printing apparatuses, ink tanks which are configured to integrate ink containers for multiple colors have been proposed.

In order to achieve stable ink supply, an ink tank of this configuration, i.e. an ink tank provided with multiple ink supply ports corresponding to ink containers for multiple colors, must be attached so that the respective ink supply ports are securely fixed to a holder of the apparatus. To achieve such secure attachment, suggested is an attachment mechanism including a mounting member called a latch lever as disclosed in Japanese Patent Laid-Open No. 10-286972.

FIG. 12 is a perspective view showing an ink tank and a holder for holding this tank on a carriage of an inkjet apparatus disclosed as an embodiment in Japanese Patent Laid Open No. 10-286972. Here, a holder 300 includes an inkjet head 100' integrally, and is configured to be attached to a carriage of an inkjet printing apparatus and to be detachable therefrom. The inner part of an ink tank 400 is partitioned into six chambers of ink containers. An ink absorber is disposed in each chamber and an ink of each color is impregnated and retained in the ink absorber. Then, six ink supply ports 401 are two-dimensionally arranged in the bottom face of the ink tank 400 so as to correspond to six chambers of the ink containers.

Meanwhile, the holder 300 includes six of chimney-shaped supply pipes (not shown), each having a filter on the tip end thereof, and are disposed in the positions corresponding to the ink supply ports. Moreover, the holder 300 includes retaining holes (not shown) for engaging two claw-like protrusions 405 provided to the ink tank 400, and an engaging hole 321 to be engaged with a latch claw 403 of a latch lever 402 of the ink tank 400.

When attaching the ink tank 400 to the holder 300, the claw-like protrusions 405 are first aligned with and fitted into the retaining holes of the holder 300. Next, the ink tank 400 is rotated pivotally around the fitted section so that the latch claw 403 of the latch lever 402 is engaged with the engaging hole 321 of the holder 300. By attaching the ink tank 400 to the holder 300 in the manner described above, it is possible to cause the filter portions of the supply pipes of the holder 300 to come into contact with the ink absorbers provided to the ink supply ports 401 of the ink tank 400. Accordingly, it is possible to individually supply, to the inkjet head 100', the six colors of the inks contained in the ink tank 400.

In addition, inkjet printing apparatuses are recently subject to downsizing in order to diversify usages, and products that are small in size yet configured to provide performance equivalent to that of desktop printing apparatuses have been released. A configuration, such as the one disclosed in Japanese Patent Laid-Open No. 2004-249710, of an ink tank that integrates ink containers for multiple colors has been proposed for the application to such a small-sized printing apparatus.

FIG. 13 is a schematic perspective view of the ink tank disclosed in Japanese Patent Laid-Open No. 2004-249710, which is viewed from the bottom face thereof. As similar to the configuration in FIG. 12, the ink tank 10 of this disclosure includes a claw-like protrusion 17 and a latch lever 16 having a latch claw 18 so that the ink tank 10 can be attached to a holder or an inkjet printing apparatus (neither them shown) by an operation similar to the one described with FIG. 12. Ink supply ports 14 for different colors are positioned along a side wall of this ink tank 10, and these ink supply ports 14, the latch claw 18 provided to the latch lever 16, and the protrusion 17 are almost linearly arranged.

In the ink tank 10 having the above-described configuration, it is possible to minimize strength degradation of an enclosure of the ink tank and to prevent deformation of the ink tank by disposing the ink supply ports 14 near the side wall of the tank, i.e. by disposing the ink supply ports 14 in appropriate positions so that rigidity is ensured by the wall face of the ink tank. Moreover, by almost linearly arranging the ink supply ports 14 and the engagement sections with the holder, i.e. by disposing the ink supply ports 14 between the claw-like protrusion 17 and the latch claw 18, it is possible to connect the multiple ink supply ports securely to ink receiving sections provided to the holder.

In recent years, ink tanks for the application to a relatively small-sized inkjet printing apparatus are desired to be able to contain inks having variety in color tones (colors and densities) in order to achieve photographic image quality. Moreover, as the printing speed is remarkably improved in recent years, ink tanks are also desired to have a high efficiency so as to supply ink more stably with a higher flow rate. To meet this demand, an increase in the diameters of ink supply ports has been attempted.

In configuring an ink tank that can meet the demands for diversification in colors and for speeding up, the following problems are likely to occur.

In general, a sealing member made of rubber configured to suppress leakage and evaporation of the ink during attachment of an ink tank is provided in the periphery of an ink supply port or an ink receiving section of the holder to be connected to the ink supply port. For this reason, a reactive force of rubber at the time of attachment becomes greater as the number of ink color tones, i.e. the number of the ink supply ports, increases. Accordingly, the structure configured to simply arrange the ink supply ports two-dimensionally, as disclosed in Japanese Patent Laid-Open No. 10-286972, has a risk of hindering smooth and secure attachment of the ink tank (degradation in the attachment property). Moreover, this structure also has a risk of hindering secure connection between the ink supply port and the ink receiving section (degradation in connectivity).

Meanwhile, the structure configured to arrange the ink supply ports linearly (Japanese Patent Laid-Open No. 2004-249710) incurs an increase in the number of ink color tones, i.e. an increase in the number of the ink supply ports and in the diameter of the ink supply ports associated with speeding up in ink supply, which leads to an increase in length of the ink tank in the direction of the arrangement of the ink supply ports, and thus hinders downsizing of the ink tank.

SUMMARY OF THE INVENTION

An object of the present invention is to improve an attachment property of an ink tank having multiple ink supply ports and connectivity of an ink supply system, and thereby to contributing to development of a structure of a small ink tank which can meet the demand for multiple-color application and the demand for speeding up in ink supply.

To attain the object, in a first aspect of the present invention, there is provided an ink tank provided with a plurality of supply ports configured to abut ink receiving portions of an inkjet printing apparatus to supply ink contained in a housing of the ink tank, and being attachable to and detachable from an attachment section of the inkjet printing apparatus, the ink tank comprising: a first engagement section provided on a first face of the housing and being able to be engaged with and locked to a first fitting section provided to the attachment section; and a second engagement section positioned on a second face of the housing opposed to the first face and being able to be engaged with and locked to a second fitting section provided to the attachment section, wherein the ink tank is attachable to the attachment section by positioning the first engagement section in the first fitting section and then engaging the second engagement section with the second fitting section by pivotally rotating the ink tank, and the plurality of supply ports are arranged on a third face of the housing positioned between the first face and the second face in a manner that the supply ports are on both sides of the center line on the third face passing through the first face and the second face, and are arranged so that distances, in the direction of the center line, between the abutting center of each of the supply ports and the first face are different from each other.

In a second aspect of the present invention, there is provided an ink tank comprising: a plurality of supply ports provided for respective types of ink contained in the ink tank and configured to abut ink receiving sections of an inkjet printing apparatus; a first engagement section provided on a first face of the ink tank and configured to be engaged with a first fitting section of an ink tank attachment section of the printing apparatus; and a second engagement section provided on an resiliently deformable operating section, which is located so as to face a second face of the ink tank opposite the first face, and configured to be engaged with a second fitting section of the attachment section, the ink tank being attached by positioning the first engagement section at the first fitting section, and by rotating pivotally about the first fitting section and then engaging the second engagement section with the second engaging section, wherein each of the plurality of supply ports has a distance from the first face to the abutting center to the ink receiving section different from each other, and the plurality of supply ports are alternately arranged on both sides of a hypothetical line assumed to be located on a third face where the supply ports are arranged and to connect the center of the first face and the center of the second face.

In a third aspect of the present invention, there is provided an ink tank comprising a plurality of supply ports provided for respective types of ink contained in the ink tank and configured to abut ink receiving sections of an inkjet printing apparatus, and being attached to an attachment section of the printing apparatus by utilizing a rotational motion of the ink tank, wherein the plurality of supply ports are arranged on a third face connecting a first face of the ink tank and a second face opposite the first face, and each of the plurality of supply ports has a distance from the first face to the abutting center to the ink receiving section different from each other, and the plurality of supply ports are alternately arranged on both sides of a hypothetical line assumed to be located on the third face where the supply ports are arranged and to connect the center of the first face and the center of the second face.

In a fourth aspect of the present invention, there is provided an ink tank comprising a plurality of supply ports provided for respective types of ink contained in the ink tank and configured to abut ink receiving sections of an inkjet printing apparatus, and being attached to an attachment section of the printing apparatus, wherein the plurality of supply ports are arranged on a third face connecting a first face of the ink tank and a second face opposite the first face, and each of the plurality of supply ports has a distance from the first face to the abutting center to the ink receiving section different from each other, and the plurality of supply ports are alternately arranged on both sides of a hypothetical line assumed to be located on the third face where the supply ports are arranged and to connect the center of the first face and the center of the second face.

In a fifth aspect of the present invention, there is provided an ink supply system comprising: an ink tank attachment section having: a head unit provided with ink receiving tubes for receiving respective inks of photo black, cyan, magenta and yellow supplied from an ink tank and for supplying to a printing head; and a holder unit provided with a wall defining a space for attaching the ink tank and a contact unit having an electrically connecting portion for communicating information with the ink tank, and an ink tank containing to be attached to the ink tank attachment section, the ink tank containing the inks of photo black, cyan, magenta and yellow, the ink tank having: supply ports provided for respective the inks contained in the ink tank and configured to abut the ink receiving tubes; and a board provided with information storage medium for storing information concerning the ink tank and an electric contact thereof, wherein the plurality of supply ports are arranged on a third face connecting a first face of the ink tank and a second face opposite the first face, each of the plurality of supply ports has a distance from the first face to the abutting center to the ink receiving section different from each other, and the plurality of supply ports are alternately arranged on both sides of a hypothetical line assumed to be located on the third face where the supply ports are arranged and to connect the center of the first face and the center of the second face, and the board is disposed astride the second and third faces and located in one area defined by the hypothetical line, the one area being opposite another area defined by the hypothetical line, the supply port closest to the second face being located in the other area.

According to the present invention, multiple supply ports are appropriately spread and disposed on a face of a housing of an ink tank. Accordingly, when turning and attaching the ink tank, it is possible to avoid receiving a reactive force as an attaching force at one time at the ink receiving sections of the printing apparatus, and thereby to achieve stable attachment while suppressing excessive inclination of the tank at the time of attachment. In this way, it is possible to improve an attachment property of the ink tank and connectivity of an ink supply system.

Further features of the present invention will become apparent from the following description of exemplary embodiments (with reference to the attached drawings).

DESCRIPTION OF THE EMBODIMENTS

Now, the present invention will be described in detail with reference to the accompanying drawings.

It is to be noted that the term "ink" in this specification is assumed to include any liquid which may be used for formation of images, designs, patterns, and the like, a treatment of the printing medium, or the processing of ink (such as coagulation or insolubilization of a pigment in the ink to be applied to the printing medium), by being applied to a printing medium.

Figure 1:
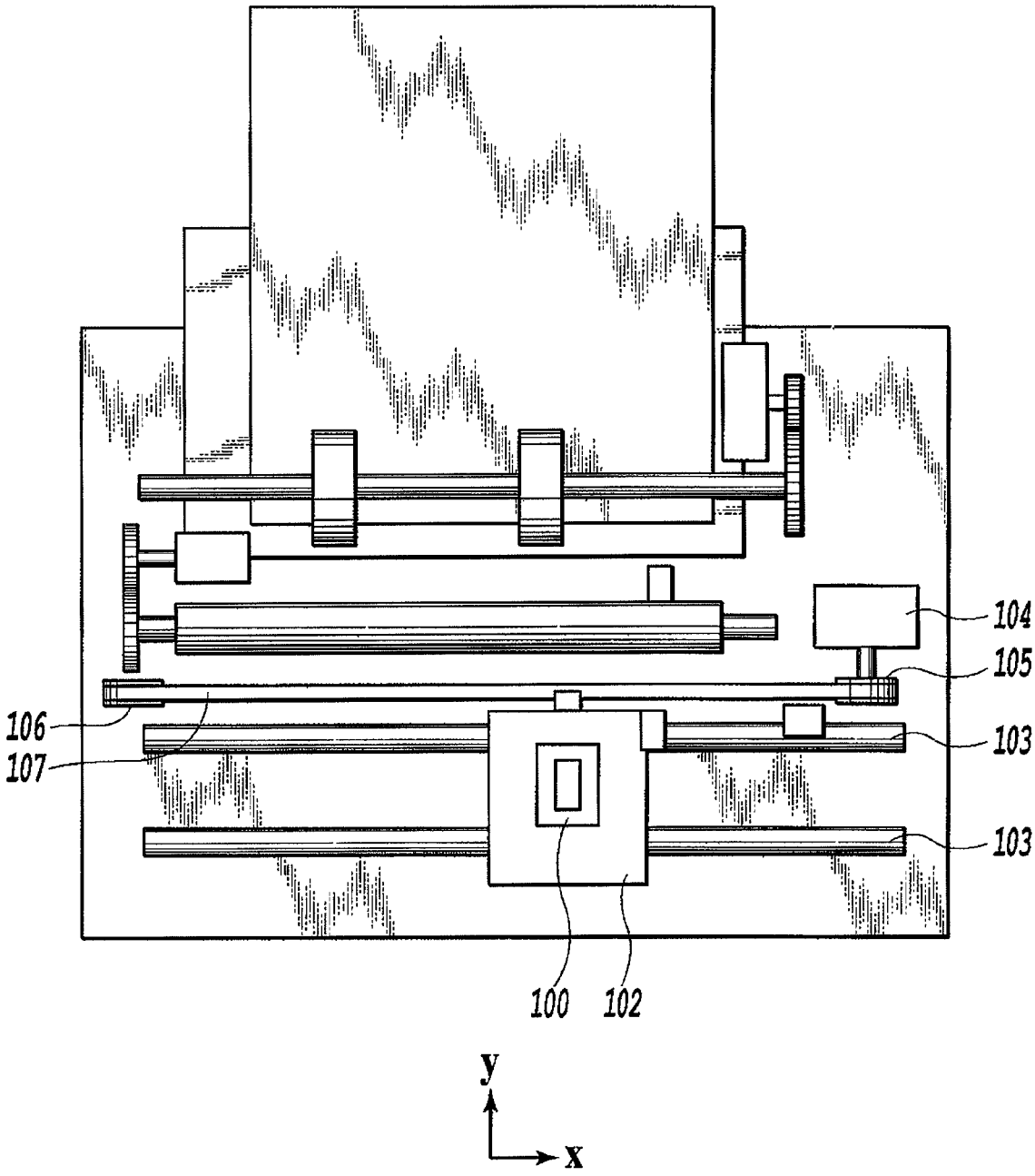
FIG. 1 is a schematic diagram showing an example of an inkjet printing apparatus to which the present invention can be applied.

FIG. 1 is a schematic diagram showing an example of an inkjet printing apparatus to which the present invention can be applied.

In FIG. 1, an ink tank attachment section 100 is positioned and mounted on a carriage 102. The carriage 102 is guided and supported so as to be able to reciprocate in an x directions along a guide shaft 103 which is disposed on an apparatus body so as to extend in a main scanning direction. Moreover, the carriage 102 is driven by a main scanning motor 104 though transmission mechanisms including a motor pulley 105, a driven pulley 106, and a timing belt 107. At the same time, the position and movements of the carriage 102 are controlled by these constituents.

Figure 2A:
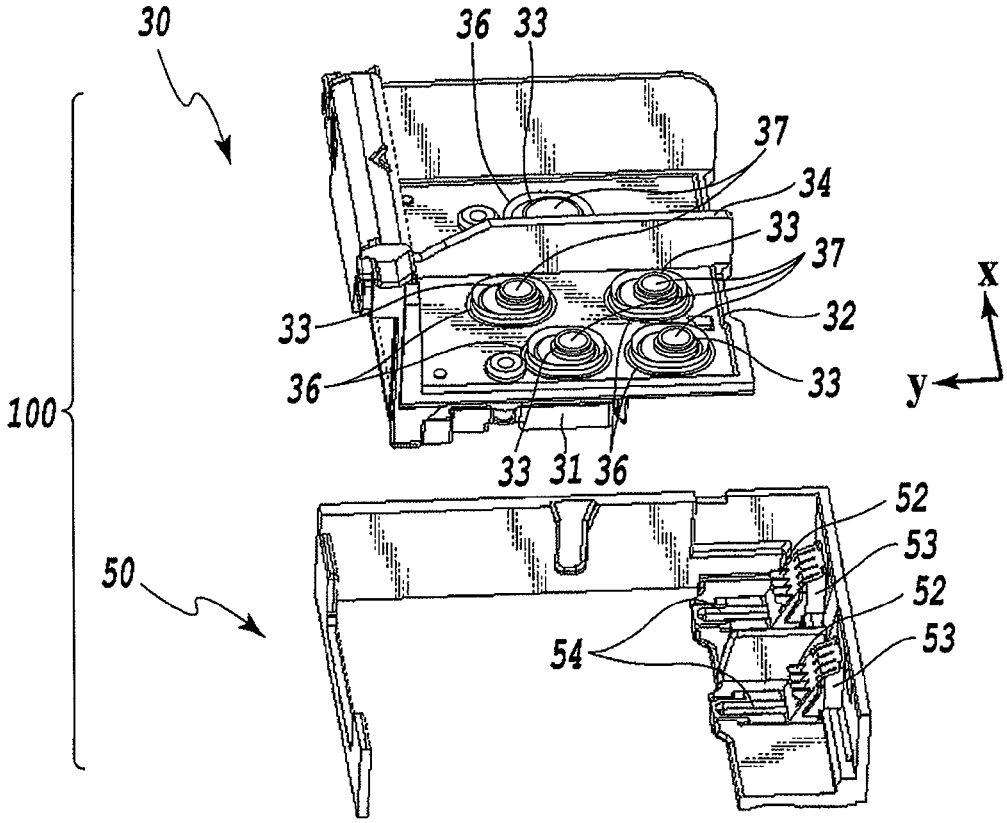
FIGS. 2A and 2B are perspective views showing a configuration example of an attachment section for attaching an ink tank according to an embodiment of the present invention.
Figure 2B:
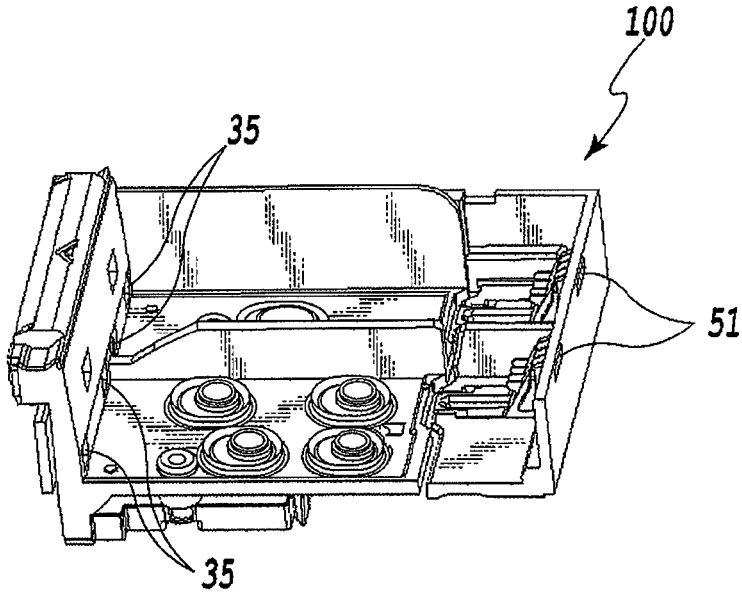

FIGS. 2A and 2B are perspective views showing a configuration example of the ink tank attachment section 100. This ink tank attachment section 100 includes a holder unit 50 and a head unit 30. FIG. 2A shows a state where the holder unit 50 and the head unit 30 are separated while FIG. 2B shows a state where these units are attached to each other. In FIGS. 2A and 2B, illustration of each side wall on one side (on the near side in the drawings; side walls located on the left side from the view point in a y direction which is orthogonal to the x direction) of the holder unit 50 and the head unit 30 is omitted in order to clarify configurations thereof. Here, the holder unit 50 and the head unit 30 constituting the ink tank attaching unit 100 will be explained on the assumption that these units are formed as separate constituents. However, the holder unit 50 and the head unit 30 may be integrally formed. Further, any other configuration may be applied as the ink tank attaching unit 100 as long as the ink tank attaching unit 100 can attach an ink tank.

The holder unit 50 is mounted to the carriage 102. Moreover, the head unit 30 is attached to the holder unit 50. In this way, an inkjet head is fixed to the printing apparatus body, and the ink tank attachment section 100 is accomplished. Here, the ink tank attachment section 100 may be configured so that the holder unit 50 is detachable or non-detachable to the carriage while the head unit 30 is detachably attached to the holder unit 50.

The head unit 30 includes an inkjet head 31 which has nozzles for ejecting ink arrayed in a direction different from the x direction, for example, in the y direction. The inkjet head 31 is integrally formed in a position defined as a bottom section of a head holder 32 in a state of being used. Multiple nozzle arrays are prepared so as to correspond to the number of ink color tones used therein. In this embodiment, the inkjet head 31 is assumed to include the nozzle array for the ink corresponding to each of the colors, black, cyan, magenta, yellow, and photo black.

Meanwhile, a black ink tank 10*a* for containing black ink is attached to the head unit 30 on the back side (on the right side viewed from the y direction) of the drawing. Moreover, a color ink tank containing color ink for four colors of cyan, magenta, yellow, and photo black is attached to the front side (on the left side viewed from the y direction) of the drawing. Then, a partition wall 34 is integrally provided on the bottom wall of the head unit 30 in order to divide regions for attaching these ink tanks 10*a* and 10*b* (which will be collectively designated by reference numeral 10 when it is not necessary to discriminate these ink tanks). This partition wall 34 includes gently inclined slope configured to reduce its level gradually in the y direction.

Further, ink receiving pipes 33, which correspond to ink supply ports 14 for the respective colors formed on an ink tank 10 to be described later, are formed in a protruding manner on the head unit 30. That is, a single ink receiving pipe for the black color is formed on an attachment section for the black ink tank 10*a* while four ink receiving pipes corresponding to cyan, magenta, yellow, and photo black colors are formed on an attachment section for the color ink tank 10*b*. Moreover, the respective ink receiving pipes 33 communicate with the nozzle arrays prepared for the ink in the respective color tones through unillustrated ink supply passages.

A sealing member 36 made of an elastic material, such as rubber, is attached around each of the ink receiving pipes 33. This sealing member 36 is configured to cover a surrounding area of each of the ink supply port 14 when the ink tank 10 is attached, thereby retaining a hermetically sealed state of an ink supply system and preventing leakage and evaporation of the ink. Meanwhile, a filter 37 for preventing invasion of foreign bodies including dusts and bubbles into the ink receiving pipe 33 is disposed to an end face of the ink receiving pipe 33.

At the time of an operation to attach the ink tank 10 to be described later, an attachment guide section 15 on the ink tank 10 is allowed to move while sliding on the partition wall 34. In this way, the ink tank 10 is guided while avoiding contact with the ink receiving pipes 33. That is, the partition wall 34 functions also as a breakage prevention guide for the ink receiving pipes 33 at the time of the operation to attach the ink tank 10.

Moreover, two of first fitting sections 35 functioning as hinges at the time of the operation to attach the ink tank and as fixation sections for the respective ink tanks at the time of attachment are provided on the back side (the left side in the drawing) in the y direction of the head unit 30. In this embodiment, the first fitting sections 35 are formed into concave sections while engagement sections (first engagement sections) located in corresponding positions on the ink tank 10 are formed into convex sections so that these constituents can be coupled together. The above-described relation may, however, be inverted.

In the meantime, a second fitting section 51 for fixation at the time of attaching each of the ink tanks 10 is located on the front side (the right side in the drawing) of the holder unit 50. This second fitting section 51 is also formed into a concave shape and can be coupled with an engagement section (a second engagement section) formed into a convex shape in a corresponding position on the ink tank 10.

Moreover, the holder unit 50 includes contact units 53 respectively provided with contact pins 52 to be electrically connected to memory elements of the ink tank 10 to be described later. The contact units 53 are connected to a control unit of the printing apparatus body through unillustrated cables. Accordingly, in the attached state of the ink tank 10, it is possible to communicate data between the control unit of the printing apparatus body and the memory elements through the contact units 53.

Next, a configuration of the ink tank will be described.

Figure 3A:
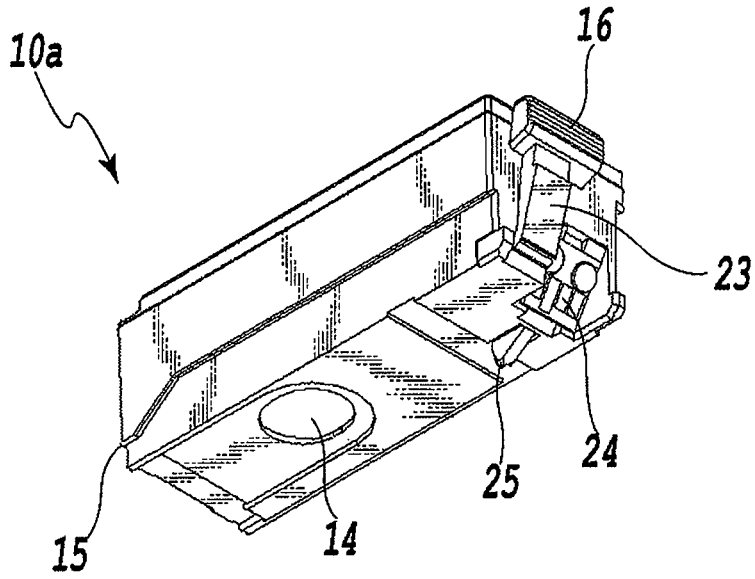
FIGS. 3A and 3B are perspective views of configuration examples of a black ink tank and a color ink tank according to the embodiment, respectively, viewed from a direction of bottom faces.
Figure 3B:
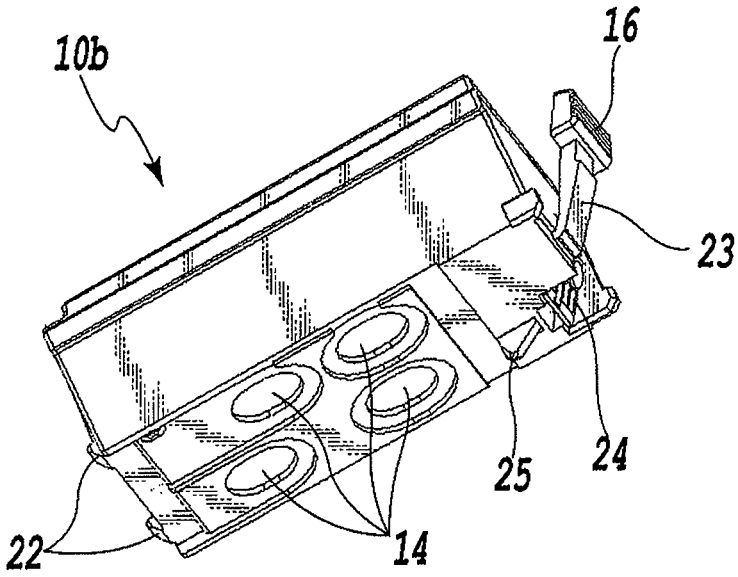
Figure 4:
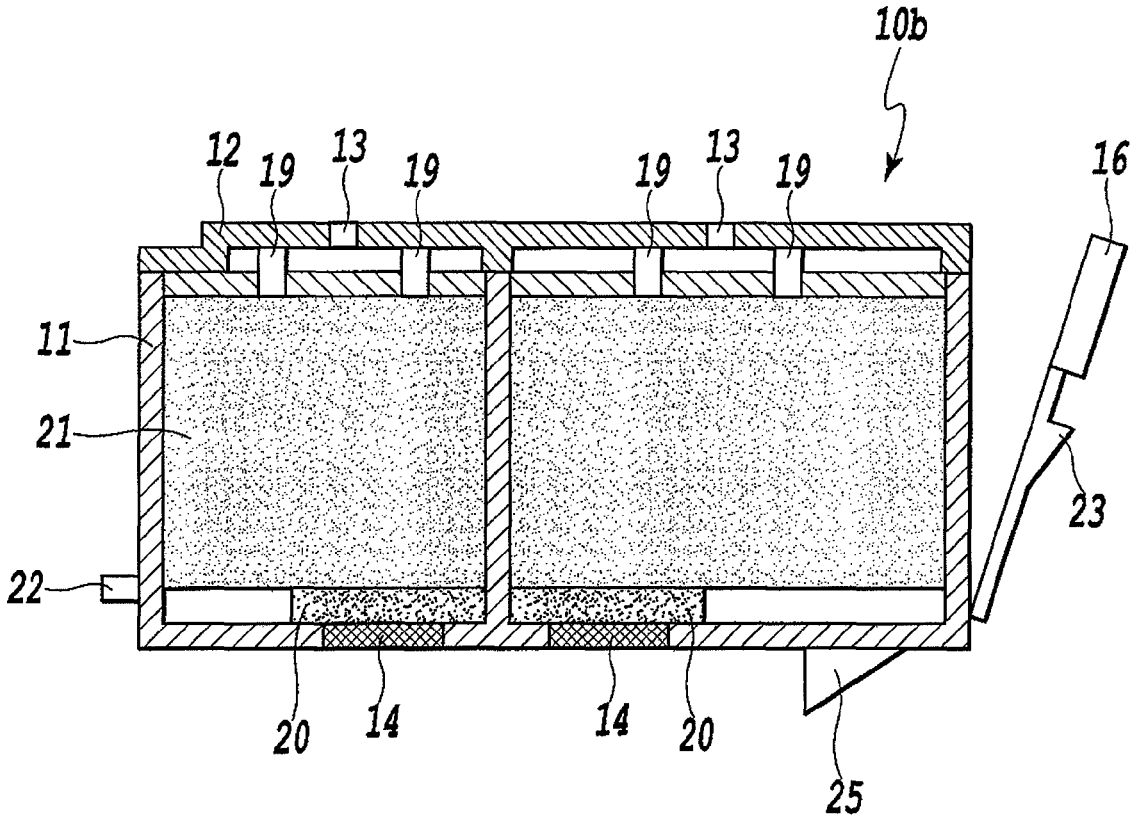
FIG. 4 is a cross-sectional view of the color ink tank of FIG. 3B.
Figure 5:
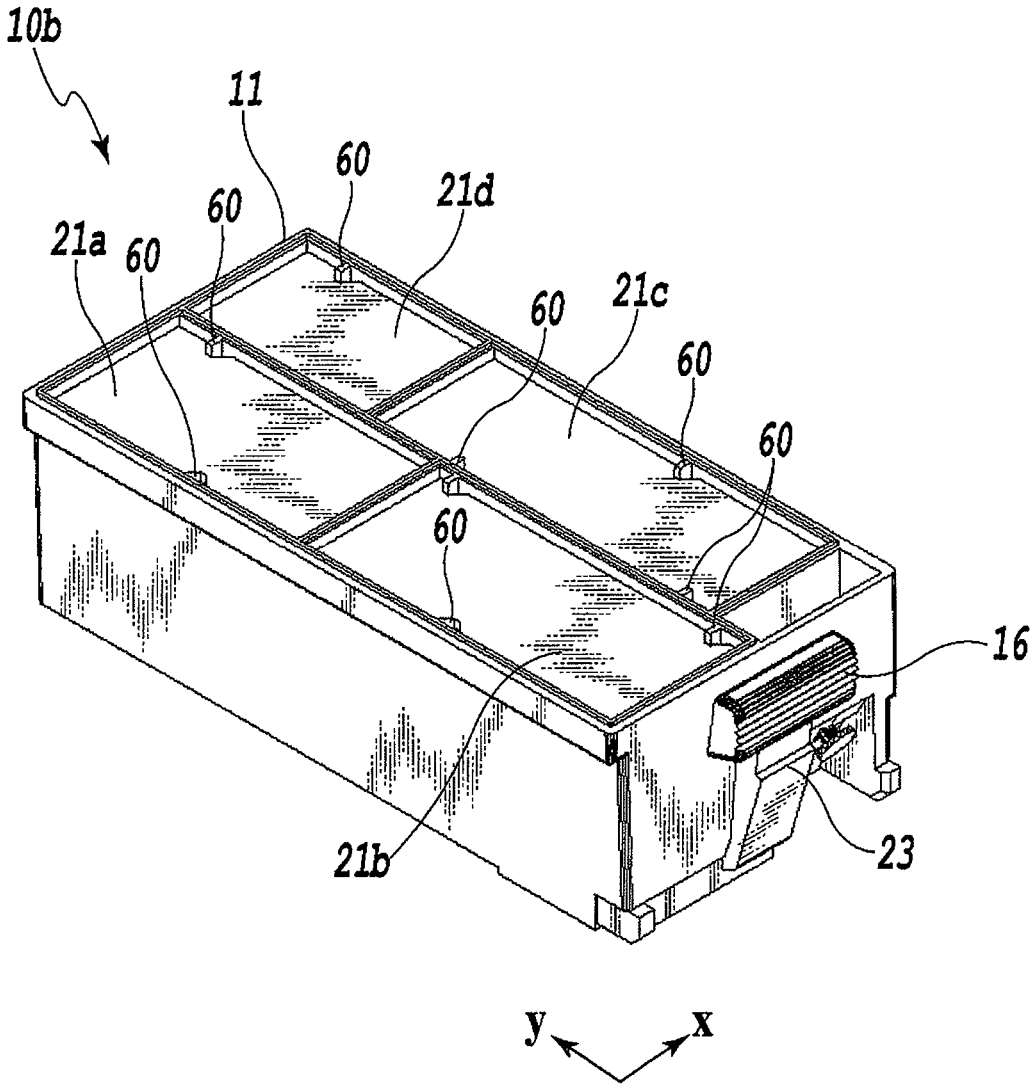
FIG. 5 is a perspective view of the color ink tank of FIG. 3B, which shows a state of taking a lid off in order to explain an internal configuration thereof.

FIGS. 3A and 3B are perspective views of configuration examples of the black ink tank 10*a* and the color ink tank 10*b* which are respectively viewed from a direction of bottom faces. Meanwhile, FIG. 4 is a schematic cross-sectional view of the color ink tank 10*b*, and FIG. 5 is a perspective view of the color ink tank 10*b* showing a state of taking a lid off in order to explain the internal configuration thereof.

The ink tanks 10*a* and 10*b* basically have the same internal structure except a difference in the number of colors of the inks to be contained. Hence, the color ink tank 10*b* will be described here as the example.

The ink tank generally includes a housing 11 having an upper end face formed into an opening and a lid member 12 for occluding the opening of the housing 11. These constituents collectively define ink containers. The lid member 12 includes air communication ports 13 for guiding air into the ink tank, and ribs 19 which are structures for forming buffering spaces for preventing ink leakage out of the air communication ports 13 in the event of an environmental change. Second ink retaining members 21 and first ink retaining members 20 for impregnating and retaining the yellow, magenta, cyan, and photo black inks and first ink retaining members 20 for ink supply are housed in spaces of the respective ink containers.

The configuration will be described more concretely by using FIG. 5. The second ink retaining members 21*a*, 21*b*, 21*c*, and 21*d* are disposed counterclockwise in the drawing from the back side in the y direction, which respectively impregnate and retain the cyan, yellow, magenta, and photo black inks. Moreover, as the ribs 19 protrude inward in the ink containers, the buffering spaces are secured between the second ink retaining members 21*a* to 21*d* and the lid member 12. Meanwhile, ribs 61 for forming air paths are provided from the bottom face to the lid of the ink tank so as to enhance reliability against the ink leakage by eliminating occluded air space inside the tank.

FIG. 4 is a cross section of the ink tank taken along the ink containers for the cyan and yellow ink. Here, the inside of the tank is divided into two sections.

On the bottom face of the housing 11, the ink supply ports 14 for ink supply are located in positions corresponding to the ink receiving pipes 33 formed on the head unit 30. In spaces between the second ink retaining members 21 and the bottom wall of the ink tank, the first ink retaining members 20 are disposed to closely contact to the second ink retaining members 21 and to occlude the ink supply ports 21 from inside.

While both of the first ink retaining member 20 and the second ink retaining member 21 are configured to impregnate and retain the ink, an ink retaining force (a capillary force) of the first ink retaining member 20 is rendered higher than an ink retaining force of the second ink retaining member 21. In this way, the ink retained in the second ink retaining member 21 is efficiently guided to the first ink retaining member 20, and consumption efficiency of the ink retained in the second ink retaining member 21 is thereby improved.

In the ink tank of this embodiment, ink capacities are set as described below in light of usage frequencies:

magenta ink capacity=yellow ink capacity ≻ cyan ink capacity>photo black ink capacity For this reason, when the partitions inside the housing are observed from above the ink tank, it is apparent that the partition walls do not have the shape of intersections of two straight lines. That is, as shown in FIG. 5, the partition wall between the cyan and yellow ink containers and the partition wall between the magenta and photo black ink containers are shifted stepwise.

In this embodiment, the ink retaining members 20 and 21 are formed by use of fiber assemblies that are made of polyolefin-based thermoplastic resin. In addition, the housing 11 and the lid member 12 are also made of a polyolefin-based thermoplastic resin material similar to the ink retaining members. Therefore, it is possible to improve recycling efficiency and reuse efficiency and thereby to offer the environment-friendly ink tank.

A latch lever 16 includes the second engagement section 23 which is formed into a protrusion so as to correspond to the second fitting section 51 for ink tank fixation provided on the holder unit 50. Moreover, first engagement section 22 formed into protrusions so as to correspond to first fitting sections 35 for ink tank fixation are provided on an opposite face with the latch lever 16.

In this embodiment, the first engagement sections are located in two positions on the face on the back side in the direction of inserting the ink tank whereas the latch lever for the ink tank including the second engagement section is located in a position near the center of the opposite face with the face on the back side. That is, the engagement sections for tank attachment are arranged to form a triangular shape. In the following description, the face provided with the latch lever 16 will be referred to as a front face of the ink tank.

Moreover, a bevel is formed in a region beside a base of the latch lever 16 within a corner area where the bottom face of the ink tank 10 meets the front face thereof. Moreover, a board 24, which mounts an information storage medium and includes a contact pad (not shown) that constitutes a contact for achieving electric connection to a contact pin provided on the holder unit, is attached to this bevel. Meanwhile, a board attachment positioning section 25 is located on the bottom face of the ink tank close to the position for attaching this board 24.

When the ink tank 10 is attached to the inkjet printing apparatus, contents stored in the information storage medium (information to be provided for achieving necessary management of the ink tank including expiration dates of use of the ink, amounts of ink inside the ink tank, and colors of the ink, for example) can be provided to the inkjet printing apparatus. In this way, it is possible to promote replacement of the ink tanks by alarming the expiration dates of use and thereby to forestall printing errors attributable to discoloration or thickening of the ink. Moreover, by detecting correct attachment of the ink tank through a success or a failure of information communication, it is possible to prevent defective printing attributed to incomplete attachment of the ink tank.

The information storage medium may apply various aspects including a magnetic medium, a magneto-optical medium, an electric storage medium, a mechanical switch such as a dual in-line package (DIP) switch, and the like as long as such a medium can offer the information by means of mechanical contact with a contact section on the inkjet printing apparatus. For example, it is possible to apply a flash memory or to apply a write-at-once type magnetic medium. Alternatively, it is possible to apply an electrically erasable programmable read-only memory (EEPROM) when it is desirable that the printing apparatus be able to add, modify or delete information (such as information on ink residual amounts or ink consumption amounts based on measurement of image data).

Next, the aforementioned operation to attach the ink tank to the printing apparatus body will be described.

Figure 6A:
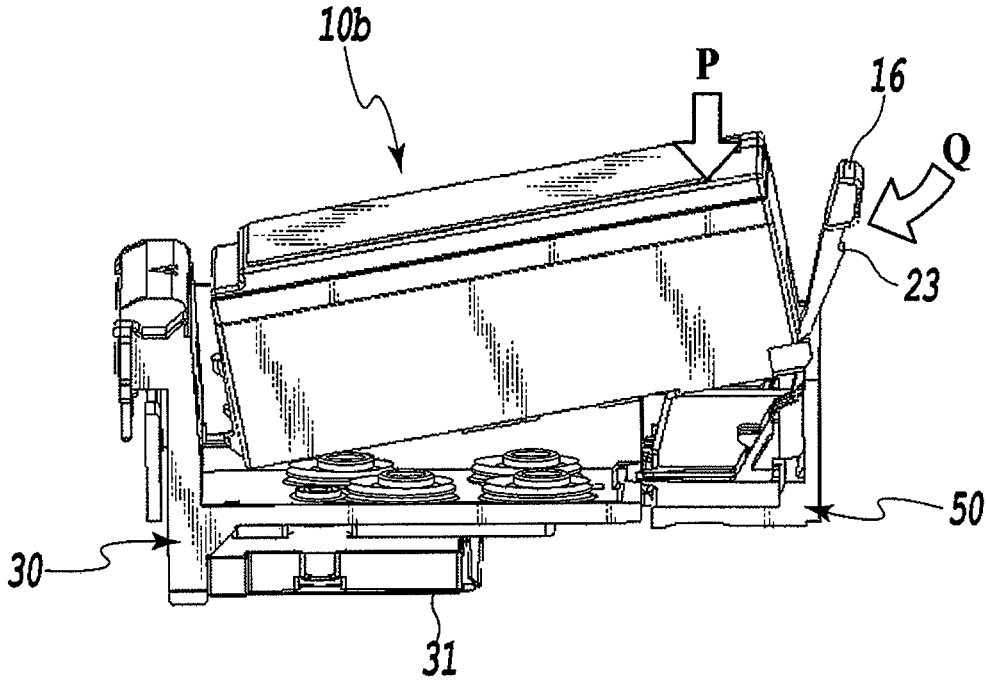
FIGS. 6A and 6B are perspective views for explaining an operation at the time of attaching the ink tank according to the embodiment.
Figure 6B:
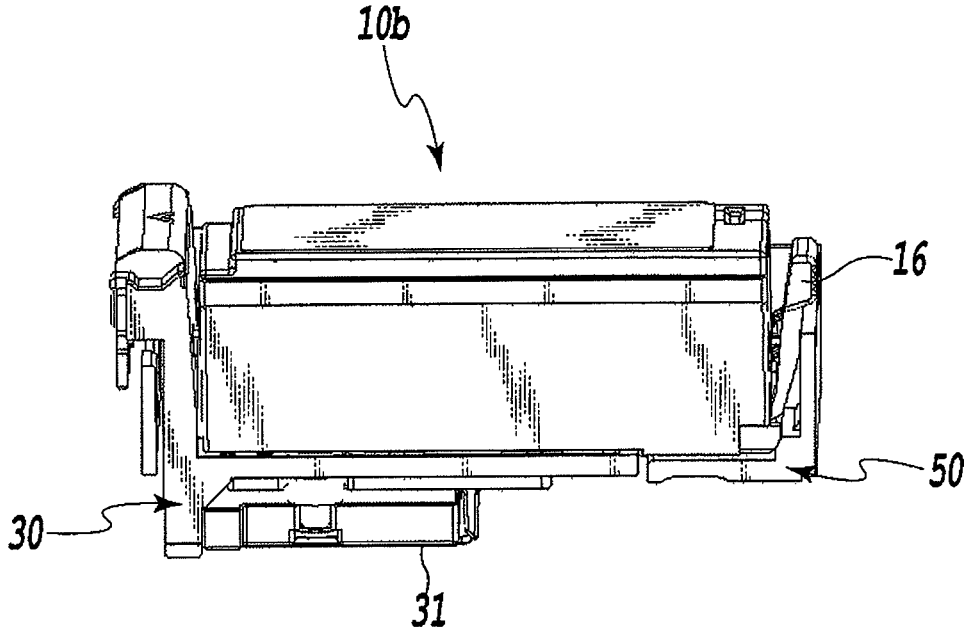

FIGS. 6A and 6B are perspective views for explaining the operation to attach the ink tank. To begin with, the ink tank 10 is placed on the head unit 30 and the holder unit 50 so as to face the first engagement sections 22 formed as the protrusions provided on the ink tank 10 with the first fitting sections 35 formed as the holes on the head unit 30.

In this state, when an upper face of the ink tank 10 is pressed in a direction indicated with an arrow P in FIG. 6A, the latch lever 16 is displaced resiliently in a direction indicated with an arrow Q. Then, the ink tank 10 is displaced downward while pushing the first engagement sections 22 on the ink tank into the first fitting sections 35 provided on the head unit 30.

In the last stage of the attachment operation, the first engagement sections 22 are engaged with the corresponding first fitting sections 35 on the head unit and the second engagement section 23 is engaged with the corresponding second fitting section 51 on the holder unit. That is, the ink tank 10 is locked in three positions of the two first fitting sections 35 and the single second fitting section 51, and the mechanically locked state is therefore completed. As a consequence, it is possible to supply the ink inside the ink tank to the nozzles of the inkjet head through the ink receiving pipes and the ink supply passages.

In the process of the attachment operation, the guide section 15 formed on the ink tank 10 slides on the partition wall 34 of the head unit, whereby a drop of the ink tank 10 into the attachment section is restricted. In the case of the color ink tank 10*b* shown in FIG. 3B, the guide section is not illustrated in the drawing because the guide section is located on the back side in this drawing. However, the structure of the guide section is the same as the guide section 15 located on the black ink tank 10*a* shown in FIG. 3A. By using these guide sections 15, it is possible to avoid contact of the ink tank with the ink receiving pipes 33 and to realize smooth attachment of the ink tank while preventing breakage of the head. In this embodiment, the partition wall 34 between the attachment sections for the black ink tank and the color ink tank is used in common as the guide for attaching these ink tanks. Here, concerning a tumble of each the ink tank toward the direction of the side face where the guide section is not present, it is possible to restrict such a tumbling motion or rolling by use of side walls of the head unit and the holder unit opposed to the side faces.

Next, a structure for positioning the board at the time of attaching the ink tank will be described below.

When attaching the ink tank, if a reactive force associated with touch of the board 24 of the ink tank on the contact unit 53 of the holder unit 50 is transmitted to the attachment section of the ink tank, there is a risk of deviation of a position to attach the ink tank or a position to attach the inkjet head to the body. Accordingly, in this embodiment, the contact unit 53 is provided separately from the holder unit so as not to transmit the reactive force, which is incurred by touch of the contact unit 53 on the board 24, to the positioning engagement sections and the like. To be more precise, the board attachment positioning section 25 formed as the protrusion provided near the board 24 of the ink tank 10 is engaged with a positioning section on the contact unit 53 so as to determine a layout between the board and the contact unit independently of positioning a point of attachment of the ink tank itself.

A mechanism (hereinafter referred to as a board positioning mechanism) to achieve the above-described configuration will be described more in detail.

Figure 7A:
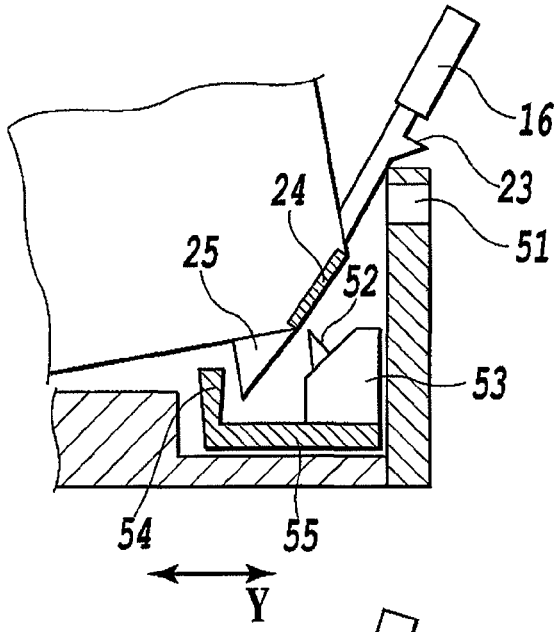
FIGS. 7A to 7C are schematic diagrams for explaining a configuration of a mechanism to position a board provided to the ink tank according to the embodiment and for explaining sequential operations at the time of attaching the ink tank.
Figure 7B:
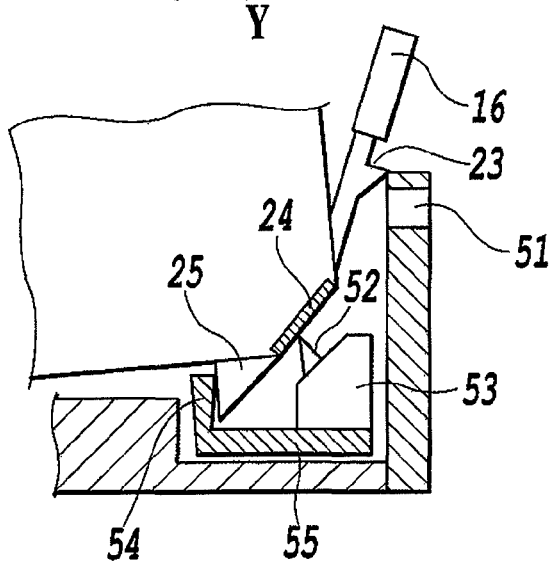
Figure 7C:
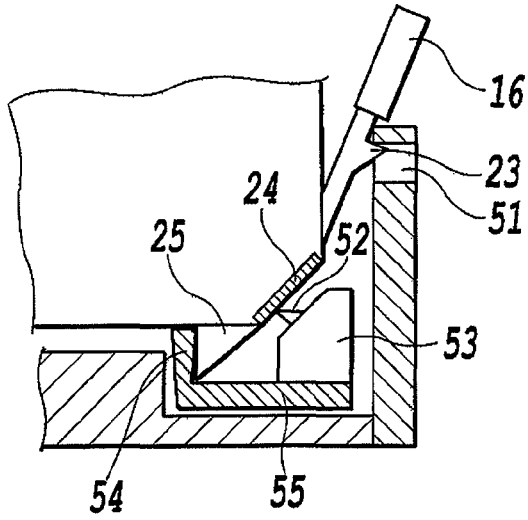

FIGS. 7A to 7C are schematic diagrams for explaining the configuration of the board positioning mechanism and for explaining sequential operations to attach the ink tank.

First, as shown in FIG. 7A, the convex board attachment positioning section 25 protrudes downward from the bottom face of the ink tank. This board attachment positioning section 25 forms a substantially triangular convex section engageable with a board-contact positioning section 54 provided on the holder unit 50 to be described later. Specifically, the board attachment positioning section 25 includes a slope configured to increase its level relative to the bottom face of the ink tank, from a region in the vicinity of the board.

On the other hand, the board-contact positioning section 54 provided on the holder unit on the printing apparatus body is formed of a base member 54 which includes a concave section which is configured to be engaged with the convex section of the board attachment positioning section 25, and the contact unit 53 is integrally provided on this base member 55. The board-contact positioning section 54 and the base member 55 are supported movably in a horizontal direction relative to the holder unit 50, and an unillustrated flexible cable for electrically connecting the printing apparatus body to the contact unit is mounted thereon. Here, the board-contact positioning section 54 may be urged toward a position shown in FIG. 7A (a position biased toward the holder unit 50) by use of an unillustrated spring when the ink tank is not attached.

As shown in FIG. 7B, in the process of the attachment operation of the ink tank 10, a tip end of the board attachment positioning section 25 provided on the tank firstly abuts an end of the board-contact positioning section 54 provided on the holder unit. In this state, when a user presses an upper end of the front face of the ink tank 10 as described previously, the ink tank 10 is rotated downward. Accordingly, the board attachment positioning section 25 and the board-contact positioning section 54 will move while maintaining abutment.

Accordingly, the contact pins 52 gradually approach the board 24 provided on the bottom face of the tank. Then, as shown in FIG. 7C, the positioning between the board 24 and the contact unit 53 is completed at the time of completion of attaching the ink tank. In this way, it is possible to establish electric connection between these constituents. In this state, the reactive force attributable to touch of the board on the contact pins of the contact unit is received by an engaged section between the board attachment positioning section 25 and the board-contact positioning section 54. Moreover, the board-contact positioning section 54 is provided on the base member 55 which is not rigidly supported by the holder unit 50. Accordingly, the reactive force associated with attachment of the board does not have an impact on the ink tank or a head unit fixation mechanism.

Next, layouts of the ink supply ports of the color ink tank constituting a characteristic feature of this embodiment will be described in details.

Figure 8A:
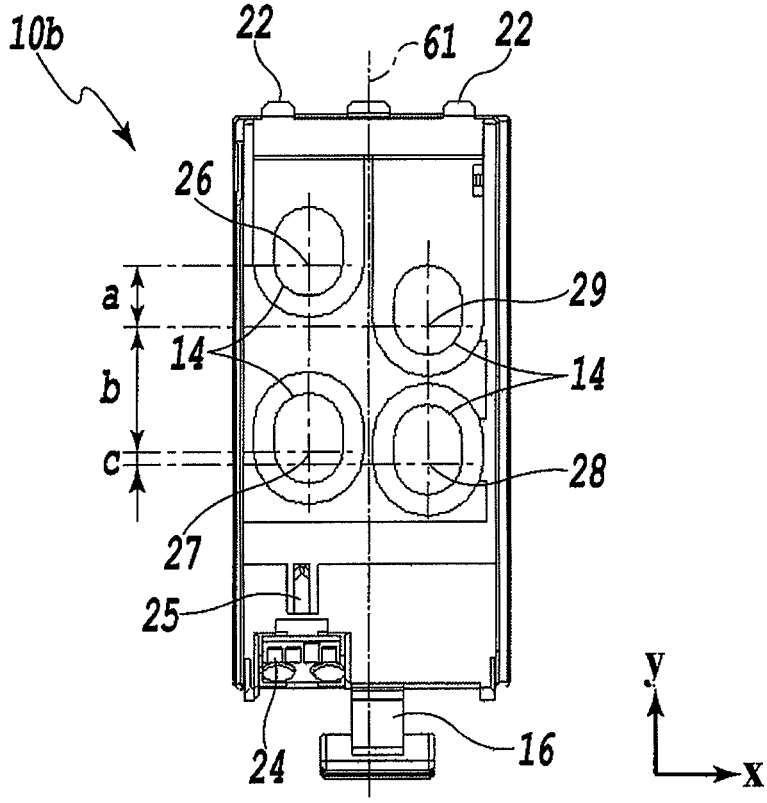
FIGS. 8A and 8B are bottom views of the color ink tank according to the embodiment.
Figure 8B:
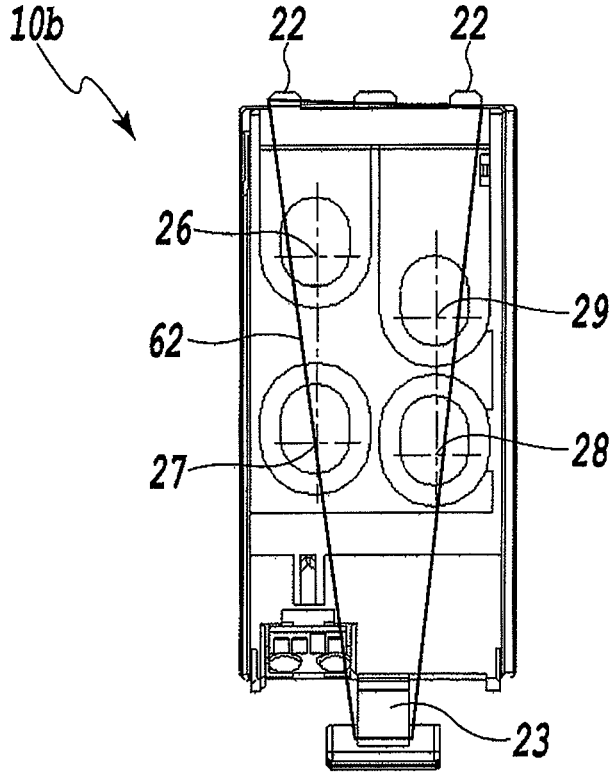

FIGS. 8A and 8B are bottom views of the color ink tank 10*b* of this embodiment the supply ports for the cyan, yellow, magenta, and photo black ink are provided on the bottom face of the color ink tank 10 to correspond to the partitions of the ink containers (FIG. 5) for the respective colors. Abutting centers when the respective ink receiving pipes abut these ink supply ports 14 are designated by reference numerals 26, 27, 28, and 29 and are indicated as intersections of broken lines in the drawings.

As apparent in FIGS. 8A and 8B, each of the ink supply ports is formed into an oblong shape extending in the direction of tank insertion (the y direction) relative to the abutting center. In this way, it is possible to avoid the ink receiving pipe from contacting the tank bottom face wall at the time of an operation to attach or detach the ink tank.

The ink supply ports 14 are two-dimensionally arranged as follows. First, as apparent in the drawings, the abutting centers of the respective ink supply ports 14 are arranged so as to be mutually shifted relative to the y direction. To be more precise, in terms of the y direction, the abutting center 26 of the photo black ink supply port, the abutting center 29 of the cyan ink supply port and the abutting center 27 of the magenta ink supply port are located from the backmost position in this order. Then, the abutting center 28 of the yellow ink supply port is located in the position closest to the front face. Meanwhile, there are two rows of ink supply ports in terms of the x direction (a width direction of the ink tank) orthogonal to the y direction. Specifically, one row is defined by the abutting centers 26 and 27 of the photo black and magenta ink supply ports while another row is defined by the abutting centers 28 and 29 for the cyan and yellow ink supply ports. These rows are located so as to sandwich a center line 61 in the width direction of the ink tank.

By arranging the ink supply ports so as to disperse the abutting centers 26 to 29 in this way, the photo black, cyan, magenta, and yellow ink supply ports are connected to the corresponding ink receiving pipes in this order when the ink tank is rotated and attached as described above. In addition, the ink tank will receive the reactive forces from the ink receiving pipes via the ink supply ports in the order of the ink supply port located on the left side of the center line, the ink supply port located on the right side, the other ink supply port on the left side, and the other ink supply port located on the right side.

Therefore, it is possible to avoid reception of the reactive forces as an attaching force at one time by the ink receiving pipes. Moreover, it is possible to achieve stable attachment while suppressing excessive inclination of the tank at the time of attachment.

Here, in this embodiment, concerning relations among the abutting center 26 of the photo black ink supply port located on the backmost side in the direction of attaching the tank, the abutting center 29 of the cyan ink supply port, and the abutting center 27 of the magenta ink supply port, layout intervals are gradually widened in this order. That is, as shown in FIG. 8A, assuming that a distance between the abutting center 26 of the photo black ink supply port and the abutting center 29 of the cyan ink supply port is defined as a and that a distance between the abutting center 29 of the cyan ink supply port and the abutting center 27 of the magenta ink supply port is defined as b, the distances a and b satisfy a relation of $a<b$.

As described above, the ink tank is rotated when it is attached. Therefore, as a place is closer to the engagement section located on the bask side, i.e. a rotating center at the time of attachment, it is possible to reduce an operating force at the time of attaching the ink tank due to the principle of leverage. For this reason, it is desirable to decrease the interval between the ink supply ports located near the rotation center and to increase the interval between the ink supply ports on the front face side or in a position away from the rotation center because such a configuration can reduce the operation force to be applied by the user and to maintain this force substantially constant.

However, since the ink supply ports are dispersed on the left side and the right side relative to the center line 61 in the width direction of the ink tank, it is conceivable that an inclination of the ink tank be increased at the time of the attachment operation along the increase in the interval between the abutting centers. For this reason, it is desirable to reduce the interval between the ink supply ports on the front face side, i.e. the region located in the most distant position from the rotation center, in light of suppression of rattles from side to side when completing attachment of the tank so as to achieve attachment of the tank reliably.

To be more precise, in this embodiment, the interval between the abutting center 27 of the magenta ink supply port and the abutting center 28 of the yellow ink supply port is set narrower than the rest of the intervals between the abutting centers of other ink supply ports. That is, assuming that the interval between the abutting center 27 of the magenta ink supply port and the abutting center 28 of the yellow ink supply port is defined as c, the values a, b, and c satisfy a relation of $c<a<b$ as shown in FIG. 8A.

Furthermore, in the ink tank of this embodiment, the ink supply ports are two-dimensionally arranged so that all the ink supply ports overlap on lines 62 defined by connecting fixing positions to attach the tank to the body (the two first engagement sections 22 and the second engagement section on the latch lever 23). This design is desirable for stabilizing the state of attachment because it is possible to receive all the reactive forces applied from the respective ink receiving pipes to the respective ink supply ports efficiently in the fixing positions to attach the tank.

It is to be noted that the present invention is not limited only to the above-described embodiment, and the invention may apply various other modifications.

For example, the above-described embodiment employs the latch lever in order to attach the ink tank. However, the present invention is effectively applicable to other aspects configured to rotate and attach the ink tank. Accordingly, it is not always necessary to employ the latch lever.

Meanwhile, the embodiment has described the ink tank using the ink absorbers made of the fiber assemblies in order to impregnate and retain the ink and to generate a preferable negative pressure that balances with meniscus retaining forces of the nozzles. However, the ink absorbers are not limited only the fiber assemblies. Meanwhile, it is also possible to separate the ink container into a container chamber including the above-described ink absorber and a container chamber configured to store the ink directly. Moreover, instead of using the ink absorber as negative pressure generating means, it is possible to fill the ink directly into a bag-like member made of an elastic material such as rubber designed to generate tension in a direction of expanding a volume, and to apply a negative pressure to the ink inside by use of the tension generated by this bag-like member. Further, it is also possible to form at least part of an ink containing space by use of an elastic member, then to put only the ink into the space, and to generate a negative pressure by applying a spring force to the elastic member.

Furthermore, the embodiment has described the ink tank configured to contain the yellow ink, the magenta ink, the cyan ink, and the photo black ink. Here, it is needless to say that the number of types of tones (the colors and densities) of the ink used therein are not limited to this configuration. In addition to the above-mentioned types of the ink, it is also possible to apply other light-tone ink, red ink, green ink, blue ink, and so forth. Particularly, the increase in the number of types of the ink may cause larger problems of an attachment property and a connection property. In this context, it is likely that the preset invention is even more effective to prevent such problems. In addition, in the case where the ink tank is configured to contain only one tone of the ink, the present invention is also applicable to such a configuration as long as multiple ink supply ports are provided therein.

Moreover, the color tone layouts and ink capacities of the ink containers are not limited only to the above-described configuration. Particularly, the aforementioned layouts of the ink supply ports may be determined irrespective of the ink capacities or the dimensions and shapes of the containers. For example, it is possible to arrange the ink supply ports as described above even in the case of using the ink containers provided for the above-mentioned four colors which have the same capacity and the same dimensions.

In addition, the embodiment has described the aspect in which the ink engagement section is separated into the head unit having the inkjet head and the holder unit formed on the body. However, it is possible to render the ink tank detachable only by use of the head unit. Alternatively, it is also possible to fix the head unit to the printing apparatus.

Incidentally, when the above-described ink tank 10 is attached to the holder unit 50, it is expected to slip the side of the ink tank 10 provided with the first engagement sections 22 below a guide plate formed above an inner wall face on the back side of the holder unit and then to push the latch lever into the holder, for example. Here, the guide plate is an overhanging member disposed at the back side provided with the first fitting sections so as to hang over an attachment space of the ink tank. However, as a result of confirmation of various operations to attach the ink tank supposed to be carried out by users, it is made clear that the attachment may be unexpectedly incomplete occasionally.

Figure 9:
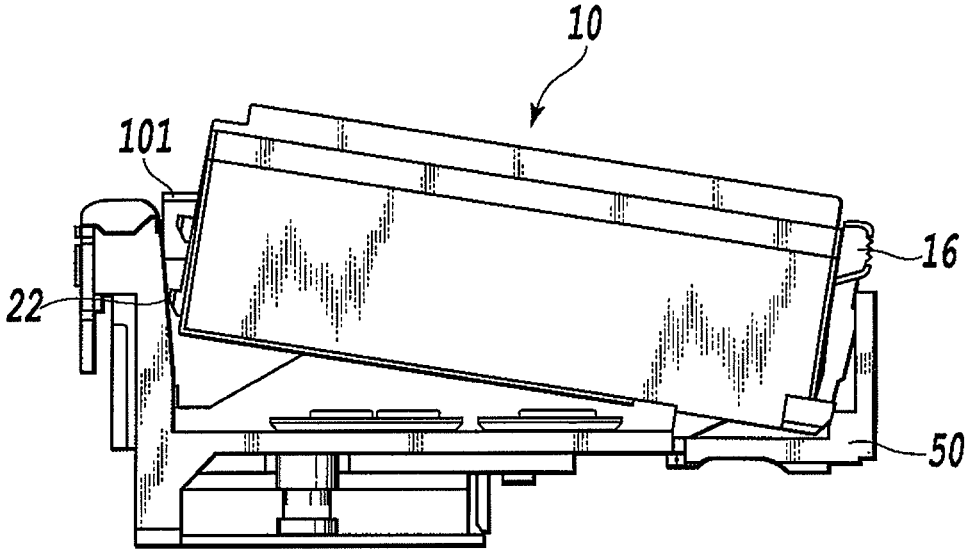
FIG. 9 is a view for explaining a problem which may occur at the time of attaching an ink tank.

Such a state is illustrated in FIG. 9. Here, although the first engagement sections 22 are inserted below a guide plate 101 of the holder unit 50, the entire back side of the ink tank 10 is not below the guide plate 101. In addition, only the side provided with the latch lever 16 is completely attached. In this case, the user may erroneously recognize completion of attachment of the entire ink tank. However, in fact, the ink receiving pipes are not connected to the ink supply ports. Therefore, it is not possible to supply the ink.

Figure 10A:
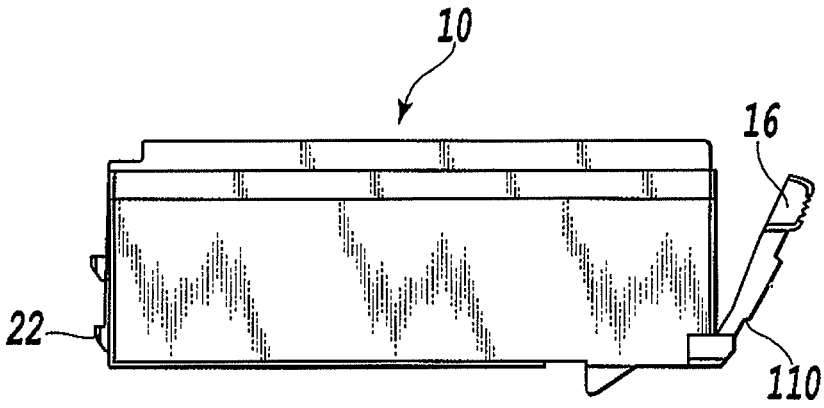
FIG. 10A is a side view and FIG. 10B is an enlarged view of a principal part of a modified example of the ink tank of the present invention for solving the problem explained in FIG. 9.
Figure 10B:
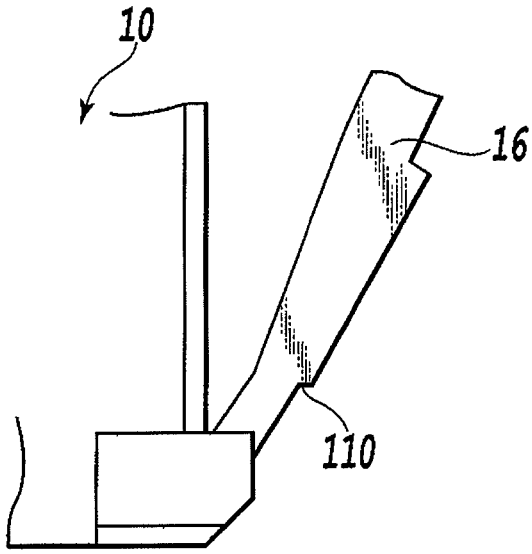

FIGS. 10A and 10B show a configuration example of the ink tank configured to avoid the state of erroneous recognition as if attachment is completed notwithstanding that it is actually not completed. As shown in FIG. 10A, in this configuration example, a step section 110 is formed in a position close to a base of the latch lever 16 on the ink tank 10. FIG. 10B is a partially enlarged view for clarifying the constitution of the step section 110.

Figure 11A:
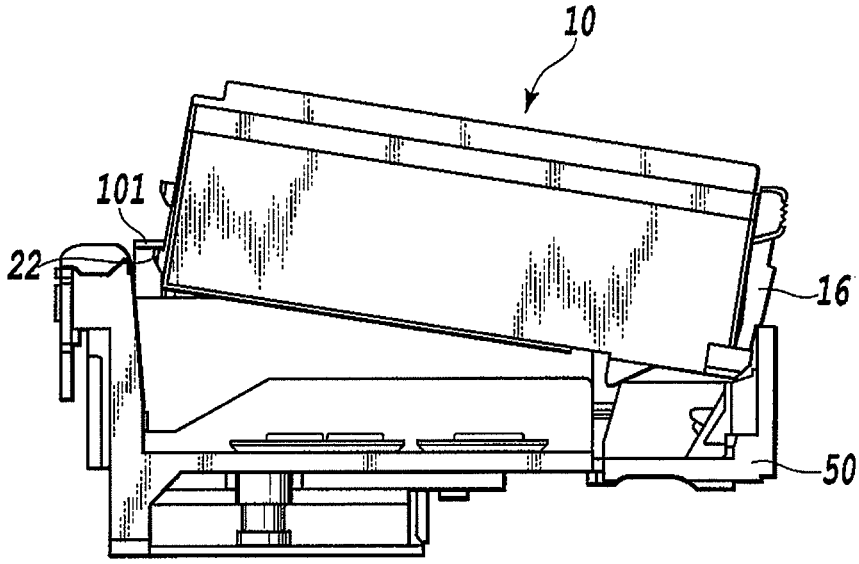
FIGS. 11A and 11B are views for explaining that an unfinished state of attachment can be clearly recognized by use of the ink tank according to the modified example.
Figure 11B:
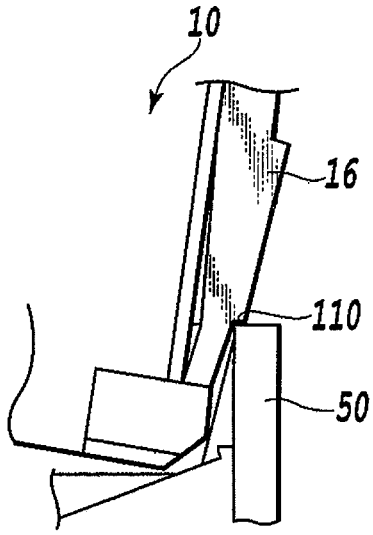
Figure 12:
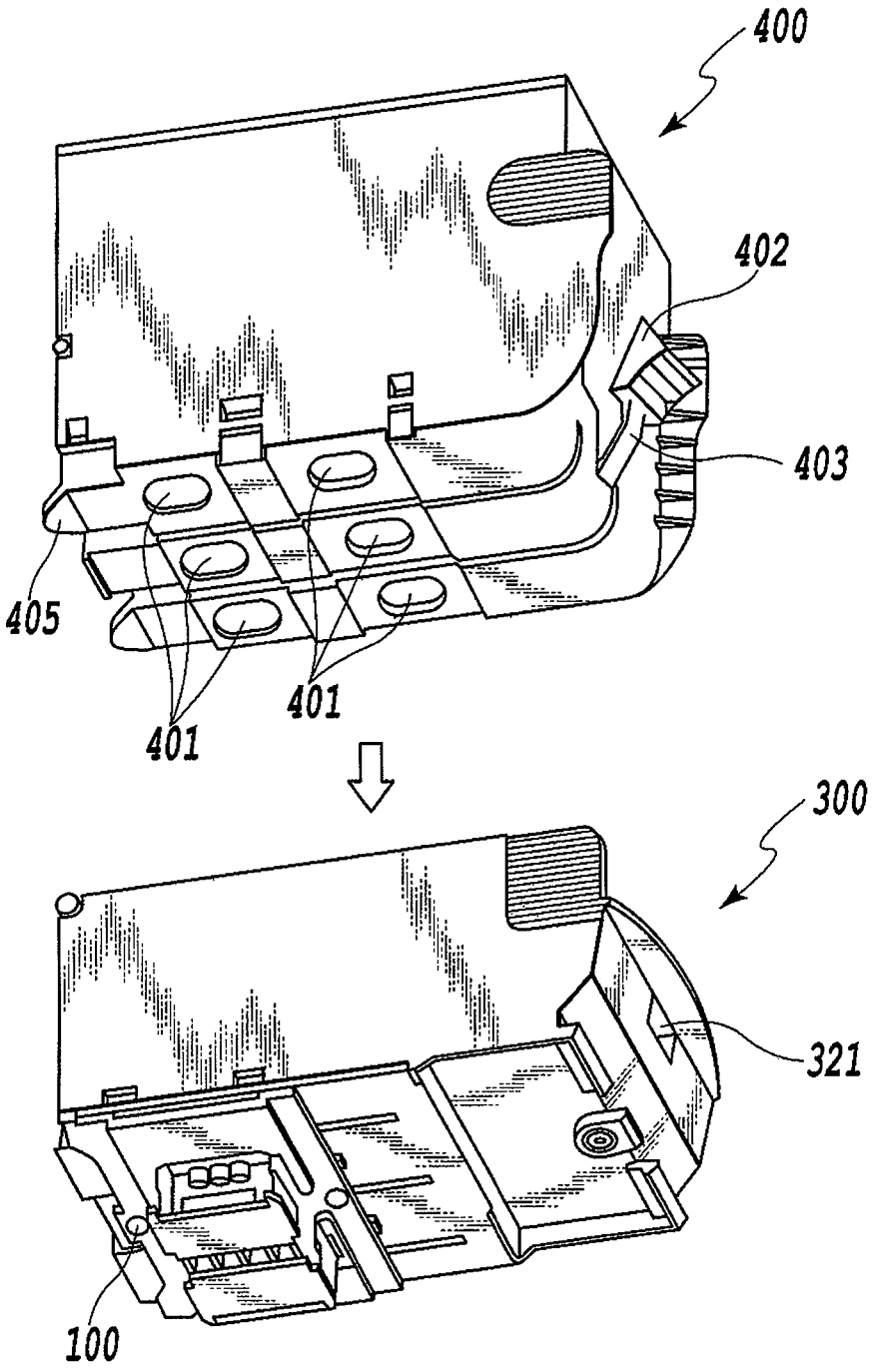
FIG. 12 is a perspective view showing an example of a conventional ink tank.
Figure 13:
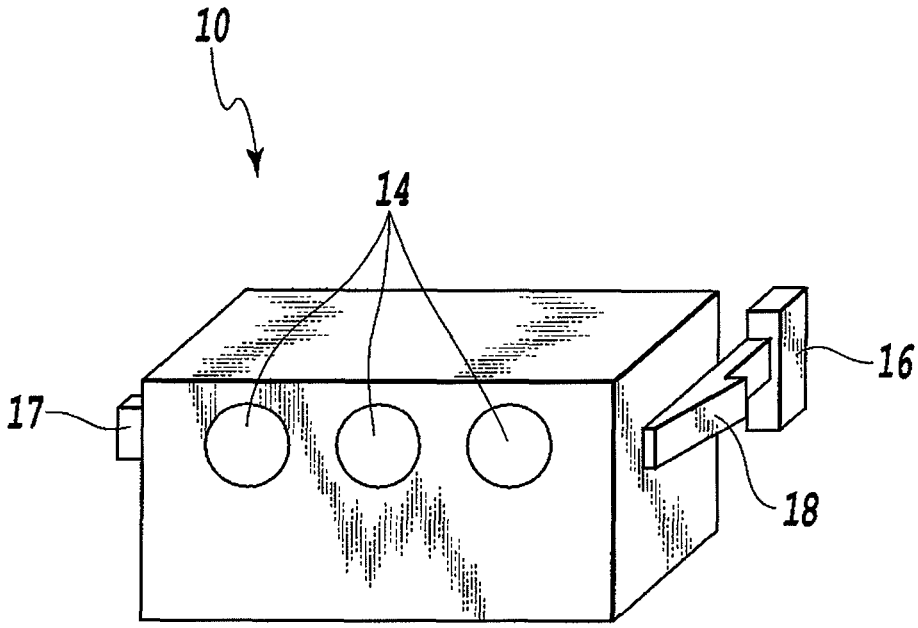
FIG. 13 is a perspective view showing another example of a conventional ink tank.

By providing the latch lever with this step section 110, the step section 110 of the latch lever 16 will abut an upper part of a wall face of the holder unit 50 as shown in FIG. 11A, when the expected attachment operation is not performed. A substantial part thereof is enlarged and illustrated in FIG. 11B. In this state, the attachment operation is restricted and the ink tank 10 therefore floats on the holder 50. Accordingly, an operator can clearly recognize that the attachment operation is incomplete. Moreover, in this state, the latch lever 16 hits the front face of the ink tank 10 and it is therefore impossible to deform the latch lever 16 further. In addition, the step section 110 of the ink tank 10 is caught by the holder unit 50 and it is therefore impossible to push the ink tank 10 further. In this way, the operator can easily recognize that the attachment is incomplete due to a wrong attachment operation.

To allow the operator to clearly recognize that the attachment of the ink tank 10 to the holder unit 50 is incomplete, it is preferable to provide the step section 110 close to the base of the latch lever 16 so that the ink tank 10 floats when the attachment is incomplete.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-227175, filed Aug. 23, 2006, and 2007-207156, filed Aug. 8, 2007 which are hereby incorporated by reference herein in their entirety.

What is claimed is:

1. An ink tank detachably attachable to an ink jet printing apparatus having a first locking portion, a second locking portion, and a plurality of ink receiving portions, comprising:

a housing containing a plurality of inks of different colors;

a first engagement portion provided on a first face of the housing, and engageable with the first locking portion;

a latch lever elastically deformable provided on a second face of the housing opposed to the first face, and having a second engagement portion engageable with the second locking portion;

a plurality of ink retaining members contained in the housing, and corresponding to the plurality of inks, respectively, the plurality of ink retaining members being positioned to abut to the plurality of ink receiving portions, respectively; and a plurality of supply ports provided at a third face of the housing which connects the first face with the second face, the plurality of supply ports corresponding to the plurality of ink retaining members, respectively, and into which the plurality of ink receiving portions are insertable to supply the plurality of inks in the plurality of ink retaining members to the plurality of ink receiving portions through a plurality of abutment areas which are areas of the plurality of ink retaining member abutting on the plurality of ink receiving portions, wherein the plurality of supply ports are provided at the third face such that (i) centers of the plurality of abutment areas are located at different positions in a direction from the first face toward the second face, (ii) a distance in the direction between the centers of two abutment areas positioned closest to the second face is the smallest among a plurality of distances in the direction between the centers of any two abutment areas, and (ii) other distances between the centers of abutment areas other than the two abutment areas increase away from the first face toward the second face.

2. The ink tank according to claim 1, wherein the third face has first and second regions which are divided by a center line in the direction of the third face, wherein the plurality of supply ports includes a first supply port provided in the first region, a second supply port provided in the first region, a third supply port provided in the second region and a fourth supply port provided in the second region, wherein the plurality of abutment areas includes a first abutment area corresponding to the first supply port, a second abutment area corresponding to the second supply port, a third abutment area corresponding to the third supply port, and a fourth abutment area corresponding to the fourth supply port, and wherein a distance between a center the first abutment area and the first face is less than a distance between a center of the third abutment area and the first face which in turn is less than a distance between a center of the second abutment area and the first face which in turn is less than a distance between a center of the fourth abutment area and the first face.

3. The ink tank according to claim 2, wherein the first engagement portion includes first and second engagement projections which are projected from the first face, the first engagement projection corresponding to the first region and the second engagement projection corresponding to the second region, wherein the first supply port and the second supply port are arranged so as to overlap a straight line which connects the first engagement projection with the second engagement portion when the ink container is viewed facing the third face, and wherein the third supply port and the fourth supply port are arranged so as to overlap a projected straight line that is a straight line which connects the second engagement projection with the second engagement portion when the ink container is viewed facing the third face.

4. The ink tank according to claim 2, wherein the two abutment areas positioned closest to the second face are the second abutment area and the fourth abutment area, wherein a distance in the direction between the center of the first abutment area and the center of the third abutment area is more than a distance in the direction between the center of the second abutment area and the center of the fourth abutment area and is less than a distance in the direction between the center of the second abutment area and the center of the third abutment area.

5. An ink tank as claimed in claim 1, further comprising an information storage medium for storing information concerning the ink tank, the information storage medium being disposed at a bevel which connects the second face with the third face and which is inclined relative to the second and third faces.

6. An ink tank as claimed in claim 1, wherein each of the plurality of supply ports has an elongate hole elongated in the direction.

7. The ink tank as claimed in claim 1, wherein the centers of the two abutment areas positioned closest to the second face are located at different positions in a second direction orthogonal to the direction.

8. An ink tank detachably attachable to an ink jet printing apparatus, comprising:

a housing containing a plurality of inks of different colors;

a first engagement portion provided on a first face of the housing;

a latch lever elastically deformable provided on a second face of the housing which is opposed to the first face, and having a second engagement portion;

a plurality of ink retaining members contained in the housing and corresponding to the plurality of inks, respectively;

a plurality of supply ports provided at a third face of the housing which connects the first face with the second face, the plurality of supply ports corresponding to the plurality of inks, respectively, and configured to supply the plurality of inks in the plurality of ink retaining members to the ink jet printing apparatus, wherein the plurality of supply ports are arranged at different positions in a direction from the first face toward the second face such that a distance in the direction between two supply ports positioned closest to the second face is the smallest among a plurality of distances in the direction between any two supply ports, and such that other distances between supply ports other than the two supply ports increase away from the first face toward the second face.

9. The ink tank according to claim 8, wherein the third face has first and second regions which are divided by a center line in the direction of the third face, wherein the plurality of supply ports includes a first supply port provided in the first region, a second supply port provided in the first region, a third supply port provided in the second region and a fourth supply port provided in the second region, and wherein a distance between the first supply port and the first face is less than a distance between the third supply port and the first face which in turn is less than a distance between the second supply port and the first face which in turn is less than a distance between the fourth supply port and the first face.

10. The ink tank according to claim 9, wherein the first engagement portion includes first and second engagement projections which are projected from the first face, the first engagement projection corresponding to the first region and the second engagement projection corresponding to the second region, wherein the first supply port and the second supply port are arranged so as to overlap a straight line which connects the first engagement projection with the second engagement portion when the ink container is viewed facing the third face, and wherein the third supply port and the fourth supply port are arranged so as to overlap a projected straight line that is a straight line which connects the second engagement projection with the second engagement portion when the ink container is viewed facing the third face.

11. An ink tank as claimed in claim 8, further comprising an information storage medium for storing information concerning management of the ink tank, the information storage medium being disposed at a bevel which connects the second face with the third face and which is inclined relative to the second and third faces.

12. An ink tank as claimed in claim 8, wherein each of the plurality of supply ports has an elongate hole elongated in the direction.

13. The ink tank as claimed in claim 8, wherein the two supply ports positioned closest to the second face are arranged at different positions in a second direction orthogonal to the direction.

14. An ink tank detachably attachable to an inkjet printing apparatus comprising a first locking portion, a second locking portion, a first ink receiving portion, a second ink receiving portion, a third ink receiving portion, and a fourth ink receiving portion, comprising:

a housing configured to contain four types of inks, the four types of inks including a first ink having a first color, a second ink having a second color, a third ink having a third color, and a fourth ink having a fourth color;

four ink retaining members contained in the housing and corresponding to the four types of inks, respectively, the four ink retaining members including (i) a first ink retaining member configured to retain the first ink, (ii) a second ink retaining member configured to retain the second ink, (iii) a third ink retaining member configured to retain the third ink, and (iv) a fourth ink retaining member configured to retain the fourth ink;

a first engagement portion provided on a first surface of the housing, and engageable with the first locking portion;

a latch lever elastically deformable provided on a second surface of the housing which is opposed to the first surface, and having a second engagement portion engageable with the second locking portion; and four supply ports provided at a third surface of the housing which connects the first surface with the second surface, the four supply ports including (i) a first supply port into which the first ink receiving portion is insertable to supply the first ink in the first ink retaining member to the first ink receiving portion through a first abutment area which is an area of the first ink retaining member abutting on the first ink receiving portion, (ii) a second supply port into which the second ink receiving portion is insertable to supply the second ink in the second ink retaining member to the second ink receiving portion through a second abutment area which is an area of the second ink retaining member abutting on the second ink receiving portion, (iii) a third supply port into which the third ink receiving portion is insertable to supply the third ink in the third ink retaining member to the third ink receiving portion through a third abutment area which is an area of the third ink retaining member abutting on the third ink receiving portion, and (iv) a fourth supply port into which the fourth ink receiving portion is insertable to supply the fourth ink in the fourth ink retaining member to the fourth ink receiving portion through a fourth abutment area which is an area of the fourth ink retaining member abutting on the fourth ink receiving portion;

wherein (i) a center of the second abutment area is more remote from the first engagement portion than a center of the first abutment area is, (ii) a center of the third abutment area is more remote from the first engagement portion than a center of the second abutment area is, and (iii) a center of the fourth abutment area is more remote from the first engagement portion than a center of the third abutment area is, and wherein (i) a distance between the center of the third abutment area and the center of the fourth abutment area in a direction from the first surface toward the second surface is less than a distance between the center of the first abutment area and the center of the second abutment area in the direction, and (ii) the distance between the center of the first abutment area and the center of the second abutment area in the direction is less than a distance between the center of the second abutment area and the center of the third abutment area in the direction.

15. An ink tank according to claim 14, wherein the third surface has a first edge intersecting with the first surface and a second edge intersecting with the second surface, and wherein the center of the first abutment area and the center of the third abutment area are located in a first region of two regions which are divided by a center line of the third surface along a first direction from the first edge toward the second edge when the ink container is viewed in a second direction from the third surface toward a fourth surface of the housing which is opposed to the third surface, and the center of the second abutment area and the center of the fourth abutment area are located in a second region of the two regions when the ink container is viewed in the second direction.

16. An ink tank detachably attachable to an inkjet printing apparatus comprising a first locking portion, a second locking portion, a first ink receiving portion, a second ink receiving portion, a third ink receiving portion, and a fourth ink receiving portion, comprising:

a housing having a bottom, a top and a plurality of sides connecting the bottom with the top, the housing being configured to contain a first ink having a first color, a second ink having a second color, a third ink having a third color, and a fourth ink having a fourth color;

a first ink retaining member contained in the housing and configured to retain the first ink;

a second ink retaining member contained in the housing and configured to retain the second ink;

a third ink retaining member contained in the housing and configured to retain the third ink;

a fourth ink retaining member contained in the housing and configured to retain the fourth ink;

a first engagement portion provided on a first side of the plurality of sides, and engageable with the first locking portion;

a latch lever elastically deformable provided on a second side of the plurality of sides which is opposed to the first side, and having a second engagement portion engageable with the second locking portion; and a first supply port into which the first ink receiving portion is insertable to supply the first ink in the first ink retaining member to the first ink receiving portion through a first abutment area which is an area of the first ink retaining member abutting on the first ink receiving portion, wherein a center of the first abutment area is located in a first region of two regions which are divided by a center line of the bottom along a first direction from a first edge of the bottom which intersects with the first side toward a second edge of the bottom which intersects with the second side when the ink container is viewed in a second direction from the bottom toward the top;

a second supply port into which the second ink receiving portion is insertable to supply the second ink in the second ink retaining member to the second ink receiving portion through a second abutment area which is an area of the second ink retaining member abutting on the second ink receiving portion, wherein a center of the second abutment area is located in a second region of the two regions when the ink container is viewed in the second direction and is more remote from the first edge in the first direction than the center of the first abutment area is;

a third supply port into which the third ink receiving portion is insertable to supply the third ink in the third ink retaining member to the third ink receiving portion through a third abutment area which is an area of the third ink retaining member abutting on the third ink receiving portion, wherein a center of the third abutment area is located in the first region of the two regions when the ink container is viewed in the second direction and is more remote from the first edge in the first direction than the center of the second abutment area is; and a fourth supply port into which the fourth ink receiving portion is insertable to supply the fourth ink in the fourth ink retaining member to the fourth ink receiving portion through a fourth abutment area which is an area of the fourth ink retaining member abutting on the fourth ink receiving portion, wherein a center of the fourth abutment area is located in the second region of the two regions when the ink container is viewed in the second direction and is more remote from the first edge in the first direction than the center of the third abutment area is, wherein (i) a distance between the center of the third abutment area and the center of the fourth abutment area in the first direction is less than a distance between the center of the first abutment area and the center of the second abutment area in the first direction, and (ii) the distance between the center of the first abutment area and the center of the second abutment area in the first direction is less than a distance between the center of the second abutment area and the center of the third abutment area in the first direction.

17. An ink tank, comprising:

a housing configured to contain four types of inks, the four types of inks including a first ink having a first color, a second ink having a second color, a third ink having a third color, and a fourth ink having a fourth color;

four ink retaining members contained in the housing and corresponding to the four types of inks, respectively, the four ink retaining members including (i) a first ink retaining member configured to retain the first ink, (ii) a second ink retaining member configured to retain the second ink, (iii) a third ink retaining member configured to retain the third ink, and (iv) a fourth ink retaining member configured to retain the fourth ink;

an engagement projection provided on a first surface of the housing;

a latch lever elastically deformable provided on a second surface of the housing which is opposed to the first surface; and four supply ports provided at a third surface of the housing which connects the first surface with the second surface, the four supply ports including (i) a first supply port configured to supply the first ink from a first supply area of the first ink retaining member to an outside of the housing, (ii) a second supply port configured to supply the second ink from a second supply area of the second ink retaining member to the outside, (iii) a third supply port configured to supply the third ink from a third supply area of the third ink retaining member to the outside, and (iv) a fourth supply port configured to supply the fourth ink from a fourth supply area of the fourth ink retaining member to the outside;

wherein (i) a center of the second supply area is more remote from the engagement projection than a center of the first supply area is, (ii) a center of the third supply area is more remote from the engagement projection than a center of the second supply area is, and (iii) a center of the fourth supply area is more remote from the engagement projection than a center of the third supply area is, and wherein (i) a distance between the center of the third supply area and the center of the fourth supply area in a direction from the first surface toward the second surface is less than a distance between the center of the first supply port and the center of the second supply port in the direction, and (ii) the distance between the center of the first supply port and the center of the second supply port in the direction is less than a distance between the center of the second supply port and the center of the third supply port in the direction.

18. An ink tank according to claim 17, wherein the third surface has a first edge intersecting with the first surface and a second edge intersecting with the second surface, and wherein the center of the first supply area and the center of the third supply area are located in a first region of two regions which are divided by a center line of the third surface along a first direction from the first edge toward the second edge when the ink container is viewed in a second direction from the third surface toward a fourth surface of the housing which is opposed to the third surface, and the center of the second supply area and the center of the fourth supply area are located in a second region of the two regions when the ink container is viewed in the second direction.

19. An ink tank according to claim 17, wherein the ink container is detachably attachable to an inkjet printing apparatus comprising a first ink receiving portion, a second ink receiving portion, a third ink receiving portion, and a fourth ink receiving portion, and wherein the first supply area is an abutment area of the first retaining member which abuts on the first ink receiving portion to supply the first ink to the first ink receiving portion as the outside when the first ink receiving portion is inserted into the first supply port, wherein the second supply area is an abutment area of the second retaining member which abuts on the second ink receiving portion to supply the second ink to the second ink receiving portion as the outside when the second ink receiving portion is inserted into the second supply port, wherein the third supply area is an abutment area of the third retaining member which abuts on the third ink receiving portion to supply the third ink to the third ink receiving portion as the outside when the third ink receiving portion is inserted into the third supply port, and wherein the fourth supply area is an abutment area of the fourth retaining member which abuts on the fourth ink receiving portion to supply the fourth ink to the fourth ink receiving portion as the outside when the fourth ink receiving portion is inserted into the fourth supply port.

20. An ink tank, comprising:

a housing having a bottom, a top and a plurality of sides connecting the bottom with the top, the housing being configured to contain a first ink having a first color, a second ink having a second color, a third ink having a third color, and a fourth ink having a fourth color;

a first ink retaining member contained in the housing and configured to retain the first ink;

a second ink retaining member contained in the housing and configured to retain the second ink;

a third ink retaining member contained in the housing and configured to retain the third ink;

a fourth ink retaining member contained in the housing and configured to retain the fourth ink;

an elastically deformable lever provided on a first side of the plurality of sides; and a first supply port configured to supply the first ink from a first supply area of the first ink retaining member to an outside of the housing, wherein a center of the first supply area is located in a first region of two regions which are divided by a center line of the bottom along a first direction from a first edge of the bottom which intersects with a second side of the plurality of sides which is opposed to the first side toward a second edge of the bottom which intersects with the first side when the ink container is viewed in a second direction from the bottom toward the top;

a second supply port configured to supply the second ink from a second supply area of the second ink retaining member to the outside, wherein a center of the second supply area is located in a second region of the two regions when the ink container is viewed in the second direction and is more remote from the first edge in the first direction than the center of the first supply area is;

a third supply port configured to supply the third ink from a third supply area of the third ink retaining member to the outside, wherein a center of the third supply area is located in the first region of the two regions when the ink container is viewed in the second direction and is more remote from the first edge in the first direction than the center of the second supply area is; and a fourth supply port configured to supply the fourth ink from a fourth supply area of the fourth ink retaining member to the outside, wherein a center of the fourth supply area is located in the second region of the two regions when the ink container is viewed in the second direction and is more remote from the first edge in the first direction than the center of the third supply area is, wherein (i) a distance between the center of the third supply area and the center of the fourth supply area in the first direction is less than a distance between the center of the first supply area and the center of the second supply area in the first direction, and (ii) the distance between the center of the first supply area and the center of the second supply area in the first direction is less than a distance between the center of the second supply area and the center of the third supply area in the first direction.

21. An ink tank according to claim 20, wherein the ink container is detachably attachable to an inkjet printing apparatus comprising a first ink receiving portion, a second ink receiving portion, a third ink receiving portion, and a fourth ink receiving portion, and wherein the first supply area is an abutment area of the first retaining member which abuts on the first ink receiving portion to supply the first ink to the first ink receiving portion as the outside when the first ink receiving portion is inserted into the first supply port, wherein the second supply area is an abutment area of the second retaining member which abuts on the second ink receiving portion to supply the second ink to the second ink receiving portion as the outside when the second ink receiving portion is inserted into the second supply port, wherein the third supply area is an abutment area of the third retaining member which abuts on the third ink receiving portion to supply the third ink to the third ink receiving portion as the outside when the third ink receiving portion is inserted into the third supply port, and wherein the fourth supply area is an abutment area of the fourth retaining member which abuts on the fourth ink receiving portion to supply the fourth ink to the fourth ink receiving portion as the outside when the fourth ink receiving portion is inserted into the fourth supply port.

22. An ink tank, comprising:

a housing having a bottom, a top and a plurality of sides connecting the bottom with the top, the housing being configured to contain a first ink having a first color, a second ink having a second color, a third ink having a third color, and a fourth ink having a fourth color;

a first ink retaining member contained in the housing and configured to retain the first ink;

a second ink retaining member contained in the housing and configured to retain the second ink;

a third ink retaining member contained in the housing and configured to retain the third ink;

a fourth ink retaining member contained in the housing and configured to retain the fourth ink;

an elastically deformable lever provided on a first side of the plurality of sides; and a first supply port provided at a first region of two regions which are divided by a center line of the bottom along a direction from a first edge of the bottom which intersects with a second side of the plurality of sides which is opposed to the first side toward a second edge of the bottom which intersects with the first side, the first supply port being configured to supply the first ink in the first ink retaining member to an outside of the housing;

a second supply port provided at a second region of the two regions and more remote from the first edge in the direction than the first supply port is, the second supply port being configured to supply the second ink in the second ink retaining member to the outside;

a third supply port provided at the first region of the two regions and more remote from the first edge in the direction than the second supply port is, the third supply port being configured to supply the third ink in the third ink retaining member to the outside; and a fourth supply port provided at the second region of the two regions and more remote from the first edge in the direction than the third supply port is, the fourth supply port being configured to supply the fourth ink in the fourth ink retaining member to the outside.

* * * * *